US008574797B2

(12) United States Patent
Hashiba et al.

(10) Patent No.: US 8,574,797 B2
(45) Date of Patent: Nov. 5, 2013

(54) ELECTROPHOTOGRAPHIC PHOTOCONDUCTOR, PROCESS CARTRIDGE, AND ELECTROPHOTOGRAPHIC IMAGE-FORMING APPARATUS

(75) Inventors: Shigeto Hashiba, Kanagawa (JP); Kazuhiro Koseki, Kanagawa (JP); Satoya Sugiura, Kanagawa (JP); Kenta Ide, Kanagawa (JP); Fuyuki Kano, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 444 days.

(21) Appl. No.: 12/858,967

(22) Filed: Aug. 18, 2010

(65) Prior Publication Data

US 2011/0217640 A1 Sep. 8, 2011

(30) Foreign Application Priority Data

Mar. 2, 2010 (JP) ..... 2010-045833

(51) Int. Cl.
*G03G 15/00* (2006.01)

(52) U.S. Cl.
USPC ..... 430/60; 430/67; 430/69

(58) Field of Classification Search
USPC ..... 430/56, 69, 70, 84, 60, 67; 399/111, 399/159
See application file for complete search history.

(56) References Cited

U.S. PATENT DOCUMENTS 5,585,212 A * 12/1996 Ueda ..... 430/58.35
6,165,662 A * 12/2000 Kato et al. ..... 430/96
2008/0311497 A1* 12/2008 Wu et al. ..... 430/59.5

FOREIGN PATENT DOCUMENTS

JP A-2001-312075 11/2001
JP B2-3770920 4/2006
JP A-2008-281723 11/2008

* cited by examiner

*Primary Examiner* — Thorl Chea
(74) *Attorney, Agent, or Firm* — Oliff & Berridge, PLC

(57) ABSTRACT

An electrophotographic photoconductor includes a base, an undercoat layer that contains a metal oxide and an electron-accepting material and has a thickness of about 3 μm or more and about 15 μm or less, and a photosensitive layer containing a polymer having a repeating unit represented by general formula (1)

General formula (1)

where $R^1$ and $R^2$ each independently represent a halogen atom, an alkyl group having 1 to 6 carbon atoms, a cycloalkyl group having 5 to 7 carbon atoms, or an aryl group having 6 to 12 carbon atoms; and m and n each independently represent an integer of 0 to 4.

17 Claims, 3 Drawing Sheets

ELECTROPHOTOGRAPHIC PHOTOCONDUCTOR, PROCESS CARTRIDGE, AND ELECTROPHOTOGRAPHIC IMAGE-FORMING APPARATUS

CROSS-REFERENCE TO RELATED APPLICATIONS

This application is based on and claims priority under 35 USC 119 from Japanese Patent Application No. 2010-045833 filed Mar. 2, 2010.

BACKGROUND (i) Technical Field

The present invention relates to an electrophotographic photoconductor, a process cartridge, and an electrophotographic image-forming apparatus.

(ii) Related Art

An image-forming apparatus that uses a photoconductor employs an image-forming process that includes use of, in sequence, a charging unit that charges a surface of the photoconductor, an exposing unit that irradiates the charged surface with light to form an electrostatic latent image, a developing unit that develops the electrostatic latent image to form a toner image, and a transfer unit that transfers the toner image onto a recording medium.

The image-forming apparatus employs either a system equipped with a charge-erasing device that erases the rest potential remaining in the photoconductor after the transfer of the toner image onto the recording medium by, for example, applying light, or a system not equipped with such a charge-erasing device.

SUMMARY

An electrophotographic photoconductor includes a base, an undercoat layer that contains a metal oxide and an electron-accepting material and has a thickness of about 3 μm or more and about 15 μm or less, and a photosensitive layer containing a polymer having a repeating unit represented by general formula (1)

General formula (1)

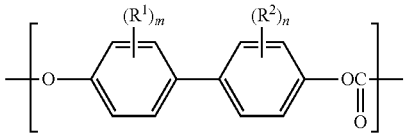

where $R^1$ and $R^2$ each independently represent a halogen atom, an alkyl group having 1 to 6 carbon atoms, a cycloalkyl group having 5 to 7 carbon atoms, or an aryl group having 6 to 12 carbon atoms; and m and n each independently represent an integer of 0 to 4.

BRIEF DESCRIPTION OF THE DRAWINGS

Exemplary embodiments of the present invention will be described in detail based on the following figures, wherein.

DETAILED DESCRIPTION

<Electrophotographic Photoconductor>

Figure 1:
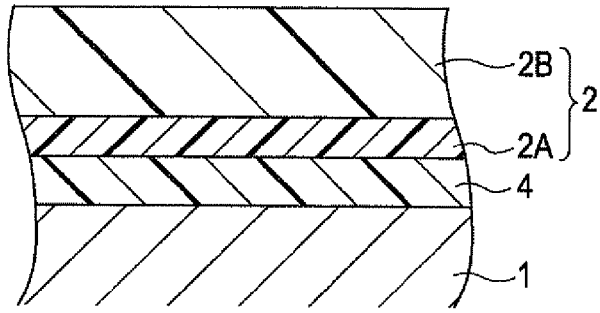
FIG. 1 is a schematic partial cross-sectional view of an electrophotographic photoconductor according to an exemplary embodiment.

An electrophotographic photoconductor (also simply referred to as "photoconductor") according to an exemplary embodiment includes a cylindrical base, an undercoat layer on the base, and a photosensitive layer on the undercoat layer. The undercoat layer contains a metal oxide and an electron-accepting material and has a thickness of 3 μm or more and 15 μm or less, or about 3 μm or more and about 15 μm or less. The photosensitive layer contains a polymer having a repeating unit represented by general formula (1) below:

General formula (1)

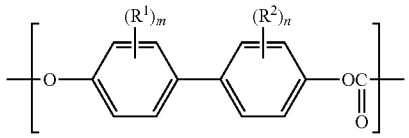

In general formula (1), $R^1$ and $R^2$ each independently represent a halogen atom, an alkyl group having 1 to 6 carbon atoms, a cycloalkyl group having 5 to 7 carbon atoms, or an aryl group having 6 to 12 carbon atoms; and m and n each independently represent an integer of 0 to 4.

The reason why accumulation of charges inside the photoconductor is suppressed by employing this structure is not exactly clear but is presumed to be attributable to the following effect.

Accumulation of negative charges in the undercoat layer is presumably suppressed since the undercoat layer of the photoconductor contains a metal oxide and an electron-accepting material and has a thickness of 3 μm or more and 15 μm or less or about 3 μm or more and about 15 μm or less. When the accumulation of negative charges in the photoconductor is suppressed, accumulation of positive charges that could occur due to the accumulation of negative charges may be suppressed. When the photosensitive layer disposed above the undercoat layer contains a polymer (also referred to as "specific polymer" hereinafter) containing a repeating unit represented by general formula (1), the hole transport property in the photosensitive layer is improved and charges do not readily accumulate in the photoconductor.

Since the photosensitive layer is disposed at the upper side of the undercoat layer (the side of the undercoat layer remote from the base), some interactions occur between the photosensitive layer and the undercoat layer and thus accumulation of negative charges does not readily occur in the undercoat layer.

Accordingly, when the photoconductor of the exemplary embodiment is used, accumulation of charges in the photoconductor may be suppressed.

As a result, the following may be achieved.

In general, a toner image electrostatically adhering to the photoconductor due to charging caused by exposure and development is transferred onto a recording medium when a voltage having a polarity opposite to that of the toner is applied to the photoconductor. Since charges do not readily accumulate in the photoconductor but flow easily in the photoconductor, the difference in surface potential between exposed portions and unexposed portions tends to be negligible when a voltage having a polarity opposite to that of the toner is applied to the photoconductor. If there is a difference in surface potential between exposed portions and unexposed portions, the toner may not adhere to portions of the photoconductor surface to which the toner is supposed to adhere but may adhere to portions to which the toner is not supposed to adhere. This phenomenon is known as an "image memory phenomenon". The photoconductor of the exemplary embodiment may suppress occurrence of this image memory phenomenon.

When the electrophotographic image-forming apparatus (also simply referred to as "image-forming apparatus" hereinafter) has no charge-erasing device and the transfer unit that applies a voltage of a reversed polarity to the photoconductor also functions as a charge-erasing device that erases surface charges on the photoconductor, only the transfer unit exhibits the charge erasing function. Accordingly, fogging and concentration abnormality, i.e., inability to form an image of a desired density due to an increase in rest potential, caused by the difference in surface potential remaining between exposed portions and unexposed portions may be suppressed.

When the image-forming apparatus is equipped with a charge-erasing device, the accumulated charges in the photoconductor may be erased more thoroughly, and thus the difference in surface potential may be further reduced and the image memory phenomenon may be further suppressed.

Next, the structure of the photoconductor of the exemplary embodiment is described in detail.

An electrophotographic photoconductor according to the exemplary embodiment includes a cylindrical base, an undercoat layer on the base, and a photosensitive layer on the undercoat layer. The undercoat layer contains a metal oxide and an electron-accepting material and has a thickness of 3 μm or more and 15 μm or less, or about 3 μm or more and about 15 μm or less. The photosensitive layer contains a polymer having a repeating unit represented by general formula (1).

The photoconductor may further include, as a surface layer, an overcoat layer that forms the uppermost surface of the photoconductor.

The electrophotographic photoconductor is described in detail below with reference to the drawings. In the drawings, the same or corresponding components are denoted by the same symbols and the repeated description thereof is omitted to avoid redundancy.

Figure 2:
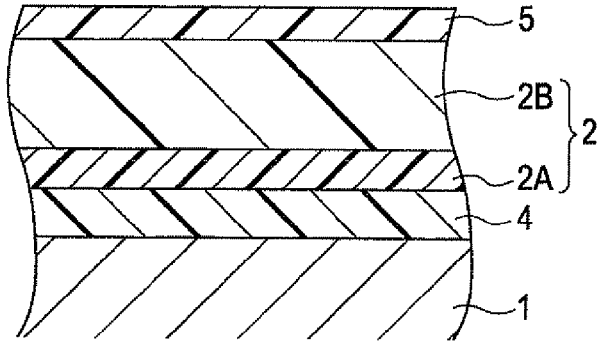
FIG. 2 is a schematic partial cross-sectional view of an electrophotographic photoconductor according to another exemplary embodiment.
Figure 3:
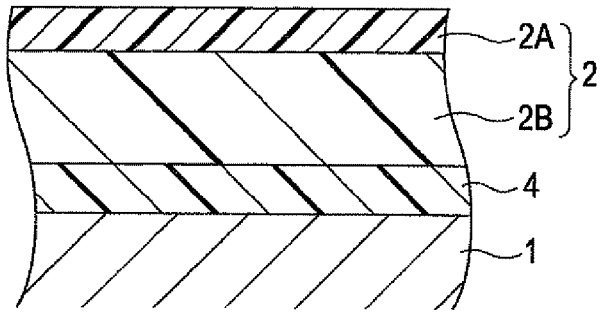
FIG. 3 is a schematic partial cross-sectional view of an electrophotographic photoconductor according to yet another exemplary embodiment.
Figure 4:
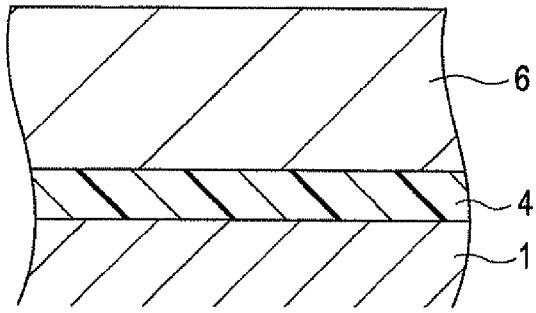
FIG. 4 is a schematic partial cross-sectional view of an electrophotographic photoconductor according to still another exemplary embodiment.

FIG. 1 is a schematic cross-sectional view showing an exemplary embodiment of the electrophotographic photoconductor. FIGS. 2 to 4 are schematic cross-sectional views showing other exemplary embodiments of electrophotographic photoconductors.

The electrophotographic photoconductor shown in FIG. 1 is a photoconductor having a photosensitive layer 2 of a layered type in which layers having separate functions are stacked. An undercoat layer 4 and the photosensitive layer 2 are formed on a base 1 in that order. The photosensitive layer 2 includes two layers, namely, a charge generation layer 2A and a charge transport layer 2B disposed in that order from the undercoat layer 4 side.

The electrophotographic photoconductor shown in FIG. 2 is a photoconductor having a photosensitive layer 2 of a layered type. An undercoat layer 4, the photosensitive layer 2, and an overcoat layer 5 are formed on a base 1 in that order. The photosensitive layer 2 includes two layers, namely, a charge generation layer 2A and a charge transport layer 2B disposed in that order from the undercoat layer 4 side.

The electrophotographic photoconductor shown in FIG. 3 is a photoconductor having a photosensitive layer 2 of a layered type. As with the electrophotographic photoconductor shown in FIG. 1, an undercoat layer 4 and the photosensitive layer 2 are formed in that order on a base 1 but the order of stacking a charge generation layer 2A and a charge transport layer 2B in the photosensitive layer 2 is different. The photosensitive layer 2 shown in FIG. 3 includes two layers, namely, a charge transport layer 2B and a charge generation layer 2A disposed in that order from the undercoat layer 4 side.

FIG. 4 shows a photoconductor including a photosensitive layer 6 of a single layer type (integrated function type) and is formed by providing an undercoat layer 4 and the photosensitive layer 6 on a base 1 in that order. The photosensitive layer 6 is a layer that has functions of both the charge generation layer 2A and the charge transport layer 2B shown in FIG. 1.

The layers of the electrophotographic photoconductor will now be described. The reference symbols are omitted in the description.

[Base]

A cylindrical base having electrical conductivity is used as the base.

The electrically conductive base is not particularly limited. Examples of the base include plastic films laminated with thin films (e.g., films of aluminum, titanium, nickel, chromium, stainless steel, gold, vanadium, tin oxide, indium oxide, and indium tin oxide), paper coated or impregnated with a conductivity-imparting agent, and plastic films coated or impregnated with a conductivity-imparting agent.

When a metal pipe is used as the base, the surface of the metal pipe may be left unprocessed or may be subjected to mirror cutting, etching, anodizing, rough cutting, centerless grinding, sand blasting, wet honing, or the like in advance.

[Undercoat Layer]

The undercoat layer contains a metal oxide and an electron-accepting material and has a thickness of 3 μm or more and 15 μm or less, or about 3 μm or more and about 15 μm or less.

The undercoat layer is provided to suppress light reflection at the base surface and flowing of unneeded charges from the base to the photosensitive layer, for example. Because the undercoat layer contains a metal oxide and an electron-accepting material, accumulation of negative charges in the undercoat layer may be suppressed. The smaller the thickness of the layer, the more unlikely the accumulation of negative charges in the undercoat layer. The upper limit of the thickness of the layer is 15 μm or about 15 μm. The lower limit of the thickness of the undercoat layer is 3 μm or about 3 μm to realize the function of the undercoat layer. The thickness of the undercoat layer is preferably 3 μm or more and 15 μm or less and more preferably 5 μm or more and 10 μm or less or about 5 μm or more and about 10 μm or less.

The metal oxide and the electron-accepting material are, for example, dispersed in a binder resin to form a coating solution for the undercoat layer and the coating solution is applied to the base.

Examples of the metal oxide include antimony oxide, indium oxide, tin oxide, titanium oxide, zinc oxide, and zirconium oxide. The metal oxides may be used alone or in combination. The form of the metal oxide is not particularly limited and may be granular or plate-like. Typically, a granular metal oxide having a volume resistivity (powder resistance) of $10^2$ Ω·cm or more and $10^{11}$ Ω·cm or less may be used.

Among these oxides, zinc oxide is particularly preferable in view of adjusting the volume resistivity of the metal oxide to $10^2$ Ω·cm or more and $10^{11}$ Ω·cm or less.

The metal oxide may be surface-treated. Two or more metal oxides having surfaces subjected to different treatments or different particle diameters may be mixed and used, for example. The volume-average particle diameter of the metal oxide may be 50 nm or more and 2000 nm or less or about 50 nm or more and about 2000 nm or less, more preferably 60 nm or more and 1000 nm or less.

A metal oxide having a specific surface area of 10 $m^2/g$ or more determined by the Brunauer-Emmett-Teller (BET) theory may be used.

The undercoat layer contains an electron-accepting material in addition to the metal oxide.

Examples of the electron-accepting material include electron transport substances, e.g., quinone compounds such as chloranil and bromanil, tetracyanoquinodimethane compounds, fluorenone compounds such as 2,4,7-trinitrofluorenone and 2,4,5,7-tetranitro-9-fluorenone, oxadiazole compounds such as 2-(4-biphenyl)-5-(4-tert-butylphenyl)-1,3,4-oxadiazole, 2,5-bis(4-naphthyl)-1,3,4-oxadiazole, and 2,5-bis(4-diethylaminophenyl)1,3,4-oxadiazole, xanthone compounds, thiophene compounds, and diphenoquinone compounds such as 3,3',5,5'-tetra-tert-butyldiphenoquinone. The electron-accepting material may be a compound having an anthraquinone structure. Electron-accepting materials having anthraquinone structures such as hydroxyanthraquinone compounds, aminoanthraquinone compounds, and aminohydroxyanthraquinone compounds may also be used. Specific examples thereof include anthraquinone, alizarin, quinizarin, anthrarufin, and purpurin. Of these, alizarin, quinizarin, anthrarufin, and purpurin are preferable.

The content of the electron-accepting material may be freely set. Usually, the electron-accepting material content is 0.01 mass % or more and 20 mass % or less relative to the metal oxide. More preferably, the electron-accepting material content is 0.05 mass % or more and 10 mass % or less.

The electron-accepting material may be added to the undercoat layer separately from the metal oxide. Alternatively, the electron-accepting material may be added to the undercoat layer after being caused to adhere to surfaces of the metal oxide.

In order to separately add the metal oxide and the electron-accepting material to the undercoat layer, the electron-accepting material and the metal oxide may simply be added to a coating solution for the undercoat layer. In order to add the metal oxide with the electron-accepting material adhering to the surfaces thereof to the undercoat layer, the electron-accepting material may be caused to adhere to the metal oxide surfaces and then the metal oxide with the electron-accepting material adhering to the surfaces thereof may be added to a coating solution for forming the undercoat layer.

Examples of the method for causing the electron-accepting material to adhere to the metal oxide surfaces (hereinafter simply referred to as "adhesion process") include a dry method and a wet method.

When the adhesion process is conducted by a dry method, the electron-accepting material, either as is or dissolved in an organic solvent, is added dropwise to the metal oxide while stirring with a mixer or the like having a large shearing force, and the resulting mixture is sprayed along with dry air or nitrogen gas to perform the process. During the addition or spraying, the temperature may be equal to or less than the boiling temperature of the solvent. After the addition or spraying, baking may further be performed at 100° C. or higher. The temperature and time of baking are set as desired.

When a wet method is employed, the metal oxide is stirred into a solvent, dispersed with ultrasonic waves, a sand mill, an attritor, a ball mill, or the like, and combined with the electron-accepting material. The resulting mixture is stirred or dispersed and the solvent is removed therefrom. The solvent is removed by filtration or distillation. After removing the solvent, baking may be conducted at 100° C. or higher. The temperature and time of baking are set as desired. In the wet method, moisture contained in the metal oxide may be removed before the surface-treating agent is added. For example, moisture may be removed by stirring and heating the mixture in a solvent used for the adhesion process or by forming an azeotrope with the solvent.

The metal oxide may be surface-treated before the electron-accepting material adheres on the surfaces. The surface-treating agent may be selected from known materials. Examples of the surface-treating agent include silane coupling agents, titanate coupling agents, aluminum coupling agents, and surfactants. A silane coupling agent is preferred and a silane coupling agent having an amino group is particularly preferred.

The surface-treating method may be any known method and may be a dry method or a wet method. Imparting the electron-accepting material and the surface treatment using a coupling agent or the like may be performed simultaneously.

The amount of the silane coupling agent relative to the metal oxide in the undercoat layer is freely set but may be 0.5 mass % or more and 10 mass % or less relative to the metal oxide.

The binder resin contained in the undercoat layer may be any known binder resin. Examples of the binder resin include known polymeric resin compounds, e.g., acetal resins such as polyvinyl butyral, polyvinyl alcohol resins, casein, polyamide resins, cellulose resins, gelatin, polyurethane resin, polyester resin, methacryl resins, acrylic resins, polyvinyl chloride resins, polyvinyl acetate resins, vinyl chloride-vinyl acetate-maleic anhydride resins, silicone resins, silicone-alkyd resins, phenolic resins, phenol-formaldehyde resins, melamine resins, and urethane resins; and electrically conductive resins such as charge transport resins having charge transport groups and polyaniline. Of these, a resin that is insoluble in the coating solvent in the upper layer is preferred; in particular, a phenolic resin, a phenol-formaldehyde resin, a melamine resin, an urethane resin, an epoxy resin, or the like is preferably used. When two or more of these resins are used in combination, the mixing ratio is set according to need.

The ratio of the metal oxide with the electron-accepting material attached on the surfaces thereof to the binder resin in the coating solution for the undercoat layer and the ratio of the metal oxide without the electron-accepting material to the binder resin are set as desired.

Various additives may be used in the undercoat layer. Examples of the additive include known materials, e.g., electron transport pigments such as fused polycyclic pigments and azo pigments, zirconium chelate compounds, titanium chelate compounds, aluminum chelate compounds, titanium alkoxide compounds, organic titanium compounds, and silane coupling agents. Silane coupling agents are used to surface-treat the metal oxide but may be used as additives to be added to the coating solution.

The solvent for preparing the coating solution for the undercoat layer is selected from known organic solvents, e.g., alcohol solvents, aromatic solvents, halogenated hydrocarbon solvents, ketone solvents, ketone alcohol solvents, ether solvents, and ester solvents.

The solvent used for dispersing the components, such as the metal oxide and the electron-accepting material, constituting the undercoat layer may be a single solvent or a mixture of two or more solvents. The solvent used for mixing may be any solvent that functions as a mixing solvent that may dissolve the binder resin.

Examples of the method for dispersing the components constituting the undercoat layer include methods that use roll mills, ball mills, vibratory ball mills, attritors, sand mills, colloid mills, and paint shakers. Examples of the coating method for forming the undercoat layer include known methods such as a blade coating method, a wire bar coating method, a spray coating method, a dip coating method, a bead coating method, an air knife coating method, and a curtain coating method.

The coating solution for the undercoat layer obtained as such is used to form an undercoat layer on the base.

The Vickers hardness of the undercoat layer may be 35 or more.

The surface roughness (ten-point mean roughness) of the undercoat layer is adjusted to ¼n (n=refractive index of the upper layer) of the exposure laser wavelength λ to ½λ to prevent moire fringe. Particles of a resin or the like may be added to the undercoat layer to adjust the surface roughness. Examples of the resin particles include silicone resin particles and cross-linking polymethyl methacrylate resin particles.

Furthermore, the undercoat layer may be polished to adjust the surface roughness. Buff polishing, sand blasting, wet honing, grinding, or the like may be employed as the polishing method.

The solution applied is dried to obtain the undercoat layer. Usually, drying is performed at a temperature at which the solvent may be evaporated and a film may be formed.

[Photosensitive Layer]

The photosensitive layer is disposed on the undercoat layer and contains a polymer (specific polymer) having a repeating unit represented by general formula (1) below:

General formula (1)

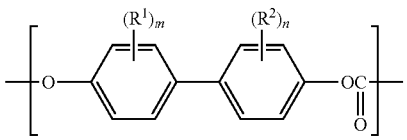

In general formula (1), $R^1$ and $R^2$ each independently represent a halogen atom, an alkyl group having 1 to 6 carbon atoms, a cycloalkyl group having 5 to 7 carbon atoms, or an aryl group having 6 to 12 carbon atoms; and m and n each independently represent an integer of 0 to 4.

Examples of the halogen atom include a fluorine atom, a chlorine atom and a bromine atom. Of these, a fluorine atom is preferred.

The alkyl group having 1 to 6 carbon atoms may be linear or branched. Examples of the linear alkyl group include a methyl group, an ethyl group, a propyl group, and a n-butyl group. Examples of the branched alkyl group include an isopropyl group and a tert-butyl group. Of these, a linear alkyl group is preferred and the number of carbon atoms is preferably 1 to 3. In particular, a methyl group, an ethyl group, and a propyl group are preferred.

Examples of the cycloalkyl group having 5 to 7 carbon atoms include a cyclopentyl group, a cyclohexyl group, and a 4-methylcyclohexyl group.

Examples of the aryl group having 6 to 12 carbon atoms include a phenyl group, a tolyl group, a mesityl group, a benzyl group, and a naphthyl group.

In general formula (1), m and n each independently represent an integer of 0 to 4. When m is 2 or more and 4 or less, $R^1$ may be the same as or different from each other. When n is 2 or more and 4 or less, $R^2$ may be the same as or different from each other.

The specific polymer may be a copolymer that contains a repeating unit represented by general formula (2) below in addition to the repeating unit represented by general formula (1):

General formula (2)

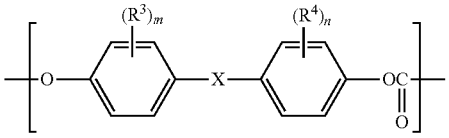

In general formula (2), $R^3$ and $R^4$ each independently represent a halogen atom, an alkyl group having 1 to 6 carbon atoms, a cycloalkyl group having 5 to 7 carbon atoms, or an aryl group having 6 to 12 carbon atoms; and m and n each independently represent an integer of 0 to 4. X represents —$CR^5R^6$—, a 1,1-cycloalkylene group having 5 to 11 carbon atoms, an α,ω-alkylene group having 2 to 10 carbon atoms, —O—, —S—, —SO—, or —$SO_2$—. $R^5$ and $R^6$ each independently represent a hydrogen atom, a trifluoromethyl group, an alkyl group having 1 to 6 carbon atoms, or an aryl group having 6 to 12 carbon atoms.

The halogen atom, the alkyl group having 1 to 6 carbon atoms, the cycloalkyl group having 5 to 7 carbon atoms, and the aryl group having 6 to 12 carbon atoms represented by $R^3$ and $R^4$, and m and n in general formula (2) are the same as the alkyl group having 1 to 6 carbon atoms, the cycloalkyl group having 5 to 7 carbon atoms, and the aryl group having 6 to 12 carbon atoms represented by $R^1$ and $R^2$, and m and n in general formula (1).

When X represents —$CR^5R^6$— and $R^5$ and $R^6$ each independently represent an alkyl group having 1 to 6 carbon atoms, the alkyl group having 1 to 6 carbon atoms may be a linear alkyl group or a branched alkyl group, e.g., a methyl group, a propyl group, an isopropyl group, or the like. The alkyl group having 1 to 6 carbon atoms may be a methyl group.

When X represents —$CR^5R^6$— and $R^5$ and $R^6$ each independently represent an aryl group having 6 to 12 carbon atoms, the aryl group having 6 to 12 carbon atoms may be, for example, a phenyl group, a benzyl group, a naphthyl group, or the like.

Examples of the 1,1-cycloalkylene group having 5 to 11 carbon atoms include a 1,1-cyclohexyl group and a 1,1-cyclooctyl group. Among these, the 1,1-cyclohexyl group is preferred.

Examples of the α,ω-alkylene group having 2 to 10 carbon atoms include an ethylene group, a propylene group, and an octylene group.

X preferably represents —$CR^5R^6$— with $R^5$ and $R^6$ each independently representing an alkyl group having 1 to 6 carbon atoms or a 1,1-cycloalkylene group having 5 to 11 carbon atoms. More preferably, X represents —$CR^5R^6$— with $R^5$ and $R^6$ both representing a methyl group or a 1,1-cyclohexylene group.

When the ratio of the repeating unit represented by general formula (1) in the specific polymer is represented by a (mol %) and the ratio of the repeating unit represented by general formula (2) is represented by b (mol %), the ratio a/b may be 0.05 or more and 0.9 or less or about 0.05 or more and about 0.9 or less. When a/b is 0.05 or more, accumulation of charges in the photoconductor may be easily suppressed. When a/b is 0.9 or less, local crystallization of the specific polymer is suppressed. Thus, a resin that satisfies this range may be used as a binder resin for the photoconductor.

The specific polymer may be a copolymer containing the repeating unit represented by general formula (1) and a repeating unit (referred to as "repeating unit c" hereinafter) other than the repeating unit represented by general formula (2). However, the ratio of the repeating unit c in the specific polymer is 10 mol % or less.

The repeating unit c may be a repeating unit of an insulating resin or a repeating unit of an organic photoconductive polymer, for example.

Examples of the insulating resin include polycarbonate resins such as those of a bisphenol A- or Z-type, acrylic resins, methacrylic resins, polyarylate resins, polyester resins, polyvinyl chloride resins, polystyrene resins, acrylonitrile-styrene copolymer resins, acrylonitrile-butadiene copolymer resins, polyvinyl acetate resins, polyvinyl formal resins, polysulfone resins, styrene-butadiene copolymer resins, vinylidene chloride-acrylonitrile copolymer resins, vinyl chloride-vinyl acetate-maleic anhydride resins, silicone resins, phenol-formaldehyde resins, polyacrylamide resins, polyamide resins, and chlorine rubber.

Examples of the organic photoconductive polymer include polyvinyl carbazole, polyvinyl anthracene, and polyvinyl pyrene.

The specific polymer containing a repeating unit represented by general formula (1) and, if occasions demand, a repeating unit represented by general formula (2) is synthesized by using a 4,4'-dihydroxybiphenyl compound represented by general formula (3) and a bisphenol compound represented by general formula (4) below through either polycondensation with a carbonate-forming compound such as phosgene or ester exchange reaction with bisaryl carbonate.

General formula (3)

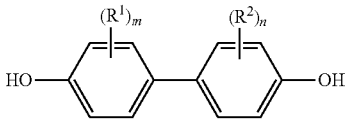

General formula (4)

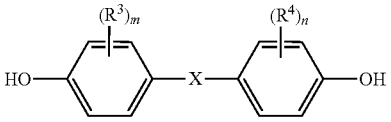

$R^1$, $R^2$, $R^3$, $R^4$, m, n, and X in general formulae (3) and (4) are the same as $R^1$, $R^2$, $R^3$, $R^4$, m, n, and X in general formulae (1) and (2).

Specific examples of the 4,4'-dihydroxybiphenyl compound represented by general formula (3) include 4,4'-dihydroxybiphenyl, 4,4'-dihydroxy-3,3'-dimethylbiphenyl, 4,4'-dihydroxy-2,2'-dimethylbiphenyl, 4,4'-dihydroxy-3,3'-dicyclohexylbiphenyl, 3,3'-difluoro-4,4'-dihydroxybiphenyl, and 4,4'-dihydroxy-3,3'-diphenylbiphenyl.

Specific examples of the bisphenol compound represented by general formula (4) include bis(4-hydroxyphenyl)methane, 1,1-bis(4-hydroxyphenyl)ethane, 1,2-bis(4-hydroxyphenyl)ethane, 2,2-bis(4-hydroxyphenyl)propane, 2,2-bis(3-methyl-4-hydroxyphenyl)butane, 2,2-bis(4-hydroxyphenyl)butane, 2,2-bis(4-hydroxyphenyl)octane, 4,4-bis(4-hydroxyphenyl)heptane, 1,1-bis(4-hydroxyphenyl)-1,1-diphenylmethane, 1,1-bis(4-hydroxyphenyl)-1-phenylethane, 1,1-bis(4-hydroxyphenyl)-1-phenylmethane, bis(4-hydroxyphenyl)ether, bis(4-hydroxyphenyl)sulfide, bis(4-hydroxyphenyl)sulfone, 1,1-bis(4-hydroxyphenyl)cyclopentane, 1,1-bis(4-hydroxyphenyl)cyclohexane, 2,2-bis(3-methyl-4-hydroxyphenyl)propane, 2-(3-methyl-4-hydroxyphenyl)-2-(4-hydroxyphenyl)-1-phenylethane, bis(3-methyl-4-hydroxyphenyl)sulfide, bis(3-methyl-4-hydroxyphenyl)sulfone, bis(3-methyl-4-hydroxyphenyl)methane, 1,1-bis(3-methyl-4-hydroxyphenyl)cyclohexane, 2,2-bis(2-methyl-4-hydroxyphenyl)propane, 1,1-bis(2-butyl-4-hydroxy-5-methylphenyl)butane, 1,1-bis(2-tert-butyl-4-hydroxy-3-methylphenyl)ethane, 1,1-bis(2-tert-butyl-4-hydroxy-5-methylphenyl)propane, 1,1-bis(2-tert-butyl-4-hydroxy-5-methylphenyl)butane, 1,1-bis(2-tert-butyl-4-hydroxy-5-methylphenyl)isobutane, 1,1-bis(2-tert-butyl-4-hydroxy-5-methylphenyl)heptane, 1,1-bis(2-tert-butyl-4-hydroxy-5-methylphenyl)-1-phenylmethane, 1,1-bis(2-tert-amyl-4-hydroxy-5-methylphenyl)butane, bis(3-chloro-4-hydroxyphenyl)methane, bis(3,5-dibromo-4-hydroxyphenyl)methane, 2,2-bis(3-chloro-4-hydroxyphenyl)propane, 2,2-bis(3-fluoro-4-hydroxyphenyl)propane, 2,2-bis(3-bromo-4-hydroxyphenyl)propane, 2,2-bis(3,5-difluoro-4-hydroxyphenyl)propane, 2,2-bis(3,5-dichloro-4-hydroxyphenyl)propane, 2,2-bis(3,5-dibromo-4-hydroxyphenyl)propane, 2,2-bis(3-bromo-4-hydroxy-5-chlorophenyl)propane, 2,2-bis(3,5-dichloro-4-hydroxyphenyl)butane, 2,2-bis(3,5-dibromo-4-hydroxyphenyl)butane, 1-phenyl1,1-bis(3-fluoro-4-hydroxyphenyl)ethane, bis(3-fluoro-4-hydroxyphenyl)ether, and 1,1-bis(3-cyclohexyl-4-hydroxyphenyl)cyclohexane.

The 4,4'-dihydroxybiphenyl compound represented by general formula (3) and the bisphenol compound represented by general formula (4) may each be used alone or as a mixture of two or more. Alternatively, one or more 4,4'-dihydroxybiphenyl compounds represented by general formula (3) and one or more bisphenol compounds represented by general formula (4) may be used as a mixture.

Examples (BP-1 to BP-18) of the specific polymer containing the repeating unit represented by general formula (1) are listed below; however, the specific polymer is not limited to the example compounds listed below. The ratio of the amount of the repeating unit in the polymer containing two or more repeating units is in terms of molar ratio. Hereinafter, the examples (BP-1 to BP-18) listed below are referred to as a specific polymer BP-1, a specific polymer BP-2, etc.

(BP-1)
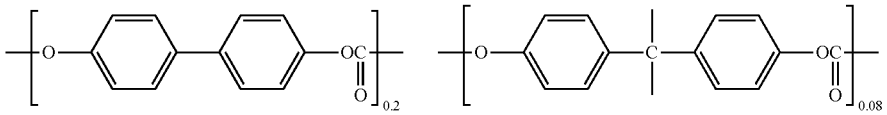
(BP-2)
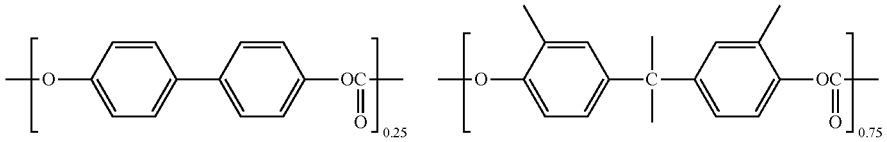
(BP-3)
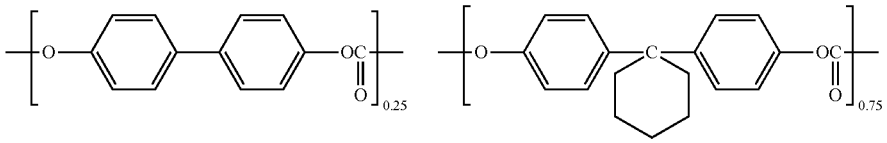
(BP-4)
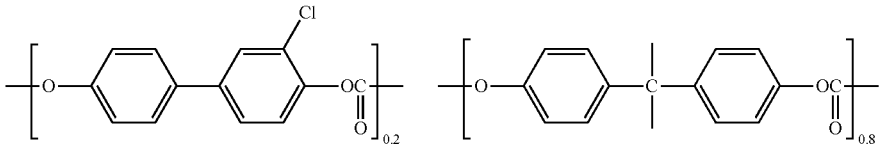
(BP-5)
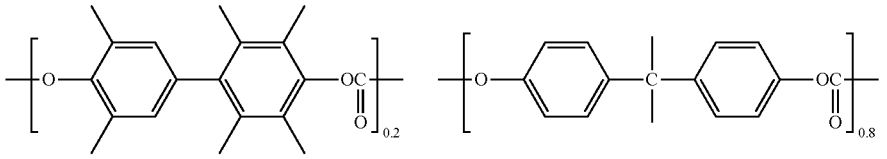
(BP-6)
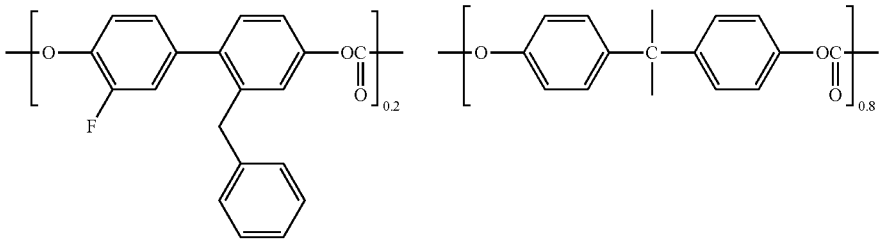
(BP-7)
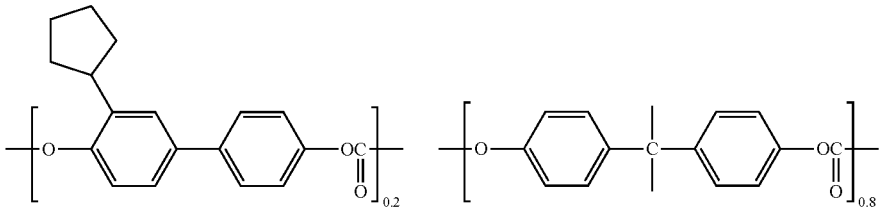
(BP-8)
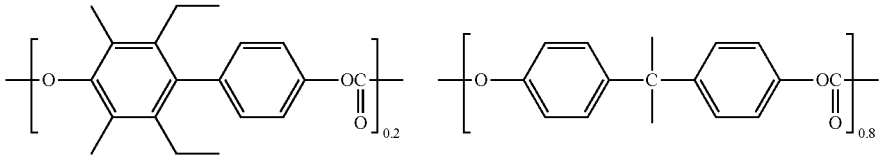
(BP-9)
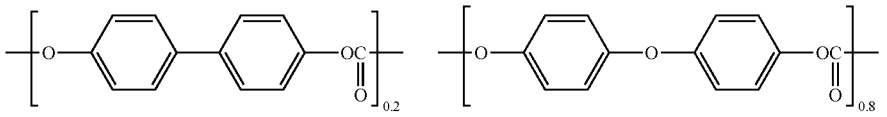

-continued
(BP-10)
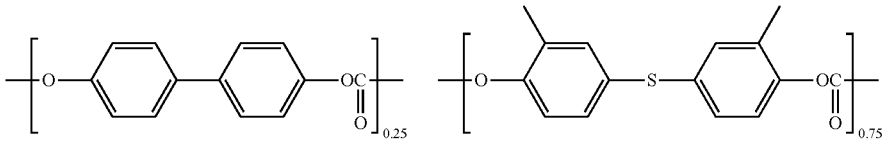
(BP-11)
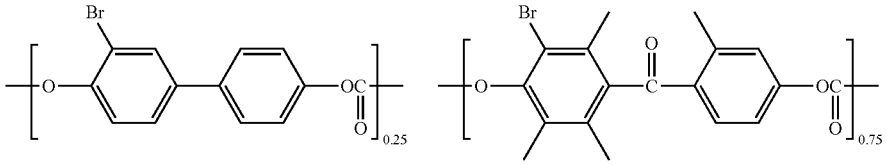
(BP-12)
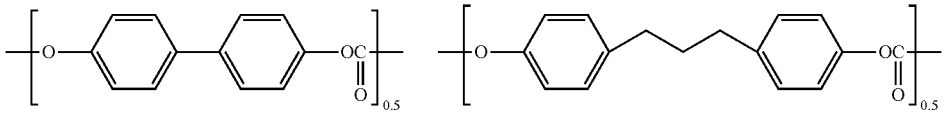
(BP-13)
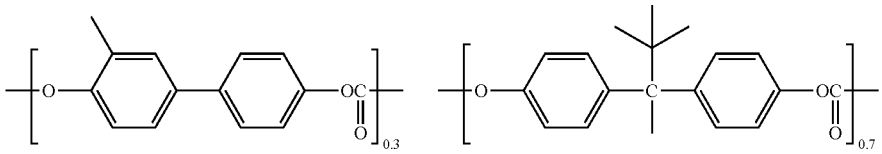
(BP-14)
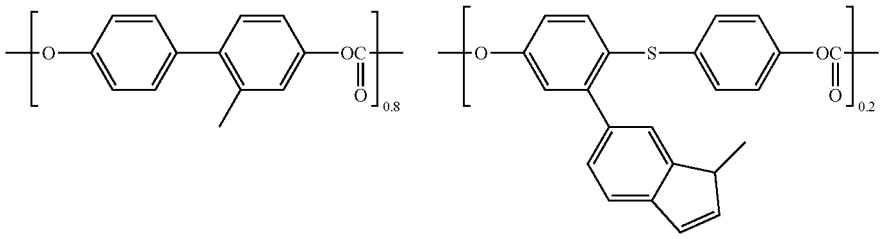
(BP-15)
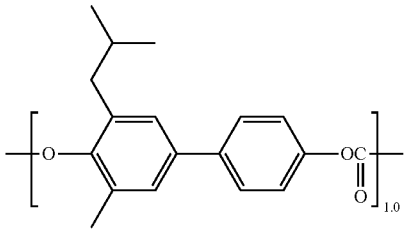
(BP-16)
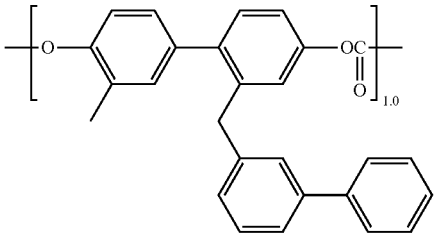
(BP-17)
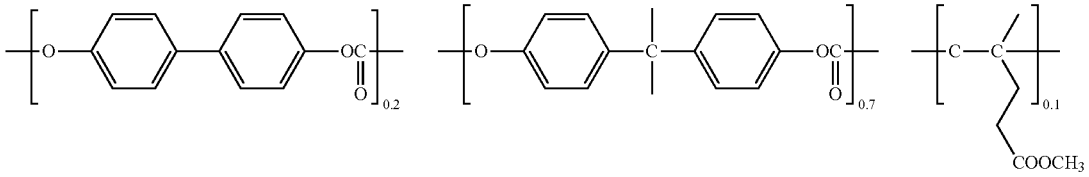
(BP-18)
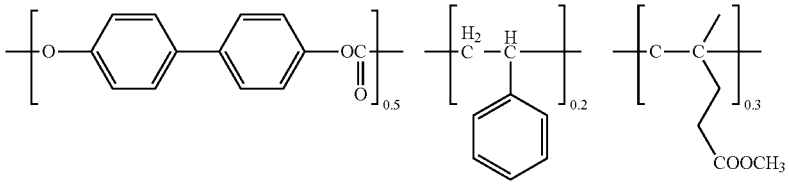

The viscosity-average molecular weight (Mv) of the specific polymer may be 30000 to 70000 or about 30000 to about 70000 from the viewpoint of strength, solubility, and coatability.

One specific polymer may be used or two or more specific polymers may be used in combination.

The content of the specific polymer in the photosensitive layer (when the photosensitive layer is of a layered type, this photosensitive layer includes a charge generation layer and a charge transport layer and when this photosensitive layer is of a single layer type, this photosensitive layer is the single layer having both charge generation and charge transport functions) may be 30 mass % or more and 80 mass % or less or about 30 mass % or more and about 80 mass % or less relative to the total solid content of the photosensitive layer on a mass basis. When the specific polymer content is about 30 mass % or more, the strength of the specific polymer may be retained. When the specific polymer content is about 80 mass % or less, the functions of the charge generation material and the charge transport material separately added may be maintained. The specific polymer content in the photosensitive layer is more preferably 50 mass % or more and 65 mass % or less relative to the total solid content of the photosensitive layer on a mass basis.

The photosensitive layer is constituted by two layers, namely, a charge generation layer and a charge transport layer, when the photosensitive layer is of a layered type, and by one layer having both charge generation and transport functions when the photosensitive layer is of a single layer type.

The specific polymer may also function as a binder resin and may have a charge transport property. When the photosensitive layer is of a layered type, the specific polymer may be contained in the charge transport layer.

When the specific polymer is contained in the charge transport layer, the content of the specific polymer in the charge transport layer is preferably 30 mass % or more and 80 mass % or less or about 30 mass % or more and about 80 mass % or less, and more preferably 50 mass % or more and 65 mass % or less relative to the total solid content of the charge transport layer on a mass basis.

The charge generation layer and the charge transport layer included in the layered-type photosensitive layer will now be described.

—Charge Generation Layer—

The charge generation layer contains, for example, a charge generation material and a binder resin. Examples of the charge generation material include phthalocyanine pigments such as metal-free phthalocyanine, chlorogallium phthalocyanine, hydroxygallium phthalocyanine, dichlorotin phthalocyanine, and titanyl phthalocyanine, in particular, a chlorogallium phthalocyanine crystal having intense diffraction peaks at Bragg angles (2θ±0.2°) of at least 7.4°, 16.6°, 25.5°, and 28.3° with respect to the CuKα X-ray, a metal-free phthalocyanine crystal having intense diffraction peaks at least Bragg angles (2θ±0.2°) of at least 7.7°, 9.3°, 16.9°, 17.5°, 22.4°, and 28.8° with respect to the CuKα X-ray, a hydroxygallium phthalocyanine crystal having intense peaks at Bragg angles (2θ±0.2°) of at least 7.5°, 9.9°, 12.5°, 16.3°, 18.6°, 25.1° with respect to the CuKα X-ray, and 28.3°, and a titanyl phthalocyanine crystal having intense peaks at Bragg angles (2θ±0.2°) of at least 9.6°, 24.1°, and 27.2° with respect to the CuKα X-ray. Other examples of the charge generation material include quinone pigments, perylene pigments, indigo pigments, bisbenzimidazole pigments, enthrone pigments, and quinacridone pigments. These charge generation materials may be used alone or as a mixture of two or more.

Examples of the binder resin contained in the charge generation layer include polycarbonate resins such as those of a bisphenol A- or Z-type, acrylic resins, methacrylic resins, polyarylate resins, polyester resins, polyvinyl chloride resins, polystyrene resins, acrylonitrile-styrene copolymer resins, acrylonitrile-butadiene copolymers, polyvinyl acetate resins, polyvinyl formal resins, polysulfone resins, styrene-butadiene copolymer resins, vinylidene chloride-acrylonitrile copolymer resins, vinyl chloride-vinyl acetate-maleic anhydride resins, silicone resins, phenol-formaldehyde resins, polyacrylamide resins, polyamide resins, and poly-N-vinylcarbazole resins. These binder resins may be used alone or as a mixture of two or more.

The blend ratio of the charge generation material to the binder resin may be, for example, 10:1 to 1:10.

A coating solution for the charge generation layer prepared by adding the above-described components to a solvent is used in forming the charge generation layer.

In order to disperse particles (e.g., charge generation material) in the coating solution for the charge generation layer, a media disperser such as a ball mill, a vibratory ball mill, an attritor, a sand mill, or a horizontal sand mill, or a media-less disperser such as an agitator, an ultrasonic disperser, a roll mill, or a high-pressure homogenizer is used. Examples of the high-pressure homogenizer include those of an collision type which conduct dispersion by liquid-liquid collision or liquid-wall collision of a dispersion under a high pressure and those of a penetration type which conduct dispersion by forcing the dispersion through fine channels under a high pressure.

Examples of the method for applying the solution for the charge generation layer on the undercoat layer include a dip coating method, a wire bar coating method, a spray coating method, a blade coating method, a knife coating method, and a curtain coating method.

The thickness of the charge generation layer is preferably 0.01 μm or more and 5 μm or less and more preferably 0.05 μm or more and 2.0 μm or less.

—Charge Transport Layer—

The charge transport layer contains a charge transport material and, if needed, a binder resin.

Examples of the charge transport material include hole transport substances such as oxadiazole derivatives such as 2,5-bis(p-diethylaminophenyl)-1,3,4-oxadiazole, pyrazoline derivatives such as 1,3,5-triphenyl-pyrazoline and 1-[pyridyl-(2)]-3-(p-diethylaminostyryl)-5-(p-diethylaminostyryl)pyrazoline, aromatic tertiary amino compounds such as triphenylamine, N,N'-bis(3,4-dimethylphenyl)biphenyl-4-amine, tri(p-methylphenyl)aminyl-4-amine, and dibenzylaniline, aromatic tertiary diamino compounds such as N,N'-bis(3-methylphenyl)-N,N'-diphenylbenzidine, 1,2,4-triazine derivatives such as 3-(4'-dimethylaminophenyl)-5,6-di-(4'-methoxyphenyl)-1,2,4-triazine, hydrazone derivatives such as 4-diethylaminobenzaldehyde-1,1-diphenylhydrazone, quinazoline derivatives such as 2-phenyl-4-styryl-quinazoline, benzofuran derivatives such as 6-hydroxy-2,3-di(p-methoxyphenyl)benzofuran, α-stilbene derivatives such as p-(2,2-diphenylvinyl)-N,N-diphenylaniline, enamine derivatives, carbazole derivatives such as N-ethylcarbazole, and poly-N-vinylcarbazole and its derivatives; electron transport substances such as quinone compounds, e.g., chloranil and bromoanthraquinone, tetracyanoquinodimethane compounds, fluorenone compounds, e.g., 2,4,7-trinitrofluorenone and 2,4,5,7-tetranitro-9-fluorenone, xanthone compounds, and thiophene compounds; and polymers that contain these hole and electron transport substances in main or side chains. These charge transport materials may be used alone or in combination.

The binder resin contained in the charge transport layer may be the specific polymer previously described or a known binder resin. Examples of the binder resin other than the specific polymer include insulating resins such as polycarbonate resins, e.g., those of a bisphenol A- or Z-type, acrylic resins, methacrylic resins, polyarylate resins, polyester resins, polyvinyl chloride resins, polystyrene resins, acrylonitrile-styrene copolymer resins, acrylonitrile-butadiene copolymer resins, polyvinyl acetate resins, polyvinyl formal resins, polysulfone resins, styrene-butadiene copolymer resins, vinylidene chloride-acrylonitrile copolymer resins, vinyl chloride-vinyl acetate-maleic anhydride resins, silicone resins, phenol-formaldehyde resins, polyacrylamide resins, polyamide resins, and chlorine rubber; and organic photoconductive polymers such as polyvinyl carbazole, polyvinyl anthracene, and polyvinyl pyrene. These binder resins may be used alone or as a mixture of two or more.

The blend ratio of the charge transport material to the binder resin (total binder resin including the specific polymer) may be, for example, 10:1 to 1:5.

The charge transport layer is formed by using a coating solution for the charge transport layer. The coating solution is prepared by adding the above-described components to a solvent.

In order to disperse particles (e.g., fluorocarbon resin particles described below) in the coating solution for the charge transport layer, a media disperser such as a ball mill, a vibratory ball mill, an attritor, a sand mill, or a horizontal sand mill, or a media-less disperser such as an agitator, an ultrasonic disperser, a roll mill, or a high-pressure homogenizer is used. Examples of the high-pressure homogenizer include those of a collision type which conduct dispersion by liquid-liquid collision or liquid-wall collision of a dispersion under a high pressure and those of a penetration type which conduct dispersion by forcing the dispersion through fine channels under a high pressure.

Examples of the method for applying the coating solution for the charge transport layer on the charge generation layer include known methods such as a dip coating method, a wire bar coating method, a spray coating method, a blade coating method, a knife coating method, and a curtain coating method.

The thickness of the charge transport layer is preferably set to 5 μm or more and 50 μm or less and more preferably 10 μm or more and 40 μm or less.

While the charge generation layer and the charge transport layer of a layered-type photosensitive layer are as described above, a photosensitive layer of a single layer type may be as follows.

The charge generation material content in the single layer-type photosensitive layer is about 10 mass % or more and about 85 mass % or less, preferably 20 mass % or more and 50 mass % or less. The charge transport material content may be 5 mass % or more and 50 mass % or less. The method for forming the single layer-type photosensitive layer (charge generation/transport layer) is the same as the method for forming the charge generation layer and the charge transport layer. The thickness of the single layer-type photosensitive layer (charge generation/transport layer) is preferably about 5 μm or more and about 50 μm or less and more preferably 10 μm or more and 40 μm or less.

[Protective Layer]

The overcoat layer is a surface layer of the photoconductor and includes, for example, an electrically conductive material and a binder resin. The overcoat layer may be formed of a cured film prepared by curing a charge transport material having polymerizable functional groups. The cured film may contain other resins if needed.

A known structure is employed as the structure of the overcoat layer.

The layer (e.g., the overcoat layer or the charge transport layer or the like when the photoconductor has no overcoat layer) which serves as a surface layer of the photoconductor may further contain fluorocarbon resin particles to improve the antifouling property and slidability of the photoconductor surface. Examples of the fluorocarbon resin particles include fluorocarbon resin particles composed of ethylene tetrafluoride, ethylene trifluoride, propylene hexafluoride, vinyl fluoride, and vinylidene fluoride, and resin particles prepared by copolymerization of a fluorocarbon resin and a hydroxyl-containing monomer described in "8th Polymer Material Forum Abstracts", p. 89. Particularly, ethylene tetrafluoride resin particles and vinylidene fluoride resin particles are preferred.

The primary particle diameter of the fluorocarbon resin particles is preferably 0.05 μm or more and 1 μm or less and more preferably 0.1 μm or more and 0.5 μm or less. When the primary particle diameter is below 0.05 μm, cohesion may easily proceed during dispersion. In contrast, when the primary particle diameter is over 1 μm, degradation of image quality tends to occur.

When the charge transport layer is the surface layer, the fluorocarbon resin particle content therein may be 2 mass % or more and 15 mass % or less relative to the total solid content in the charge transport layer. When the fluorocarbon resin particle content in the charge transport layer is less than 2 mass % relative to the total solid content, the charge transport layer may not be sufficiently modified by dispersion of the fluorocarbon resin particles. When the content exceeds 15 mass %, the dispersibility may degrade and the film strength may decrease.

In order to disperse fluorocarbon resin particles in the surface layer, a coating solution may be prepared by dispersion using a media disperser such as a ball mill, a vibratory ball mill, an attritor, a sand mill, or a horizontal sand mill, or a media-less disperser such as an agitator, an ultrasonic disperser, a roll mill, a high-pressure homogenizer, or a Nanomizer (manufactured by Yoshida Kikai Co., Ltd.). Examples of the high-pressure homogenizer include those of a collision type which conduct dispersion by liquid-liquid collision or liquid-wall collision of a dispersion under a high pressure and those of a penetration type which conduct dispersion by forcing the dispersion through fine channels under a high pressure.

When a fluorine surfactant or a fluorine graft polymer is used as a dispersion stabilizer for the fluorocarbon resin particles in the surface layer, the dispersibility of the coating solution is stabilized. The fluorine graft polymer may be a resin prepared by graft-polymerizing a macromonomer composed of an acrylate compound, a methacrylate compound, a styrene compound, or the like with perfluoroalkylethyl methacrylate.

The fluorine surfactant or fluorine graft polymer content may be 1 mass % or more and 5 mass % or less relative to the total mass of the fluorocarbon resin particles.

Oil such as silicone oil may be added to the surface layer for the same purpose. Examples of the silicone oil include dimethyl polysiloxane, diphenyl polysiloxane, and phenylmethylsiloxane, and reactive silicone oil such as amino-modified polysiloxane, epoxy-modified polysiloxane, carboxyl-modified polysiloxane, carbinol-modified polysiloxane, fluorine-modified polysiloxane, methacryl-modified polysiloxane, mercapto-modified polysiloxane, and phenol-modified polysiloxane.

[Image-Forming Apparatus/Process Cartridge]

An image-forming apparatus according to a first exemplary embodiment is an electrophotographic image-forming apparatus that includes the electrophotographic photoconductor described above, a charging unit that charges a surface of the electrophotographic photoconductor, an exposing unit that exposes the charged electrophotographic photoconductor to form an electrostatic latent image, a developing unit that develops the electrostatic latent image by using charged toner having a particular polarity to form a toner image, and a transfer unit that applies to the toner image and the electrophotographic photoconductor a voltage having an opposite polarity with respect to the toner to transfer the toner image onto a recording medium. The image-forming apparatus does not include a charge-erasing unit that erases charges of the electrophotographic photoconductor after transfer of the toner image onto the recording medium and before charging of the electrophotographic photoconductor surface.

An image-forming apparatus according to a second exemplary embodiment is an electrophotographic image-forming apparatus that includes the electrophotographic photoconductor described above, a charging unit that charges the surface of the electrophotographic photoconductor, an exposing unit that expose the charged electrophotographic photoconductor to form an electrostatic latent image, a developing unit that develops the electrostatic latent image by using charged toner having a particular polarity to form a toner image, a transfer unit that applies to the toner image and the electrophotographic photoconductor a voltage having an opposite polarity with respect to the toner to transfer the toner image onto a recording medium, and a charge-erasing unit that erases charges of the electrophotographic photoconductor.

A process cartridge according to a first exemplary embodiment is a process cartridge that is detachably mountable to an electrophotographic image-forming apparatus and that at least includes the electrophotographic photoconductor described above but does not include a charge-erasing unit that erases charges of the electrophotographic photoconductor after transfer of a toner image onto a recording medium and before charging.

A process cartridge according to a second exemplary embodiment is a process cartridge that is detachably mountable to an electrophotographic image-forming apparatus and that includes the electrophotographic photoconductor described above and a charge-erasing unit that erases charges of the electrophotographic photoconductor.

The image-forming apparatus of the first exemplary embodiment and the process cartridge of the first exemplary embodiment will now be described in detail with reference to FIG. 5.

Figure 5:
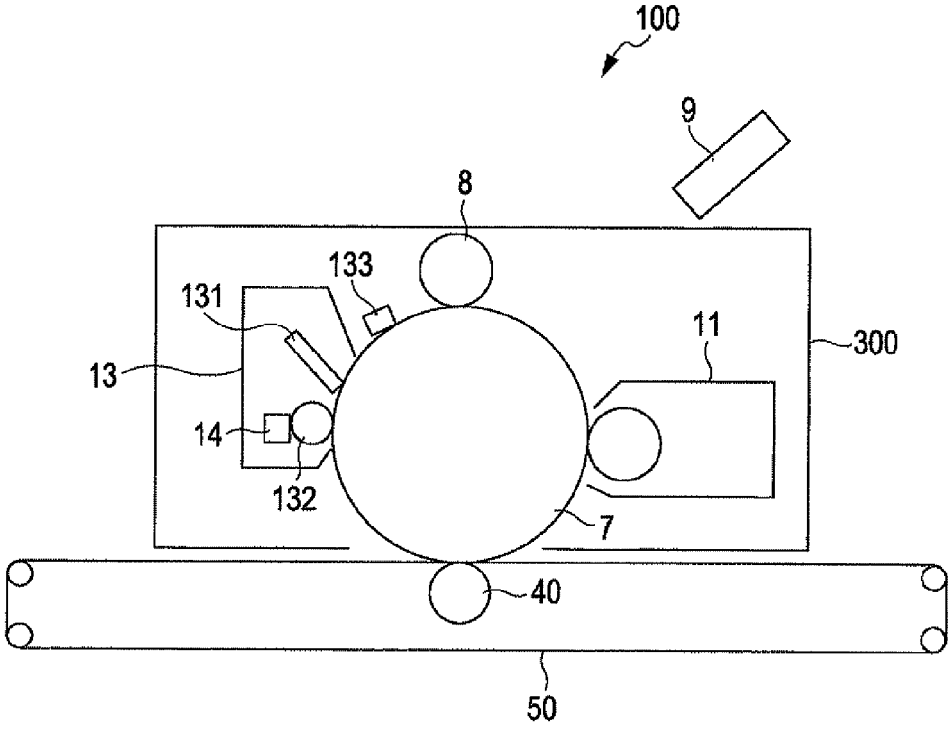
FIG. 5 is a schematic diagram of an image-forming apparatus according to an exemplary embodiment.

FIG. 5 is a schematic diagram showing an image-forming apparatus 100.

The image-forming apparatus 100 shown in FIG. 5 includes a process cartridge 300 equipped with an electrophotographic photoconductor 7, which is one of the electrophotographic photoconductors described above, an exposure device (exposing unit) 9, a transfer device (transfer unit) 40, and an intermediate transfer member 50. In the image-forming apparatus 100, the exposure device 9 is disposed at a position that allows exposure of the electrophotographic photoconductor 7 from an opening formed in the process cartridge 300. The transfer device 40 is disposed at a position that opposes the electrophotographic photoconductor 7 with the intermediate transfer member 50 therebetween. Part of the intermediate transfer member 50 is in contact with the electrophotographic photoconductor 7.

The process cartridge 300 in FIG. 5 includes the electrophotographic photoconductor 7, a charging device (charging unit) 8, a developing device (developing unit) 11, and a cleaning device (cleaning unit) 13 that are integrally supported in a housing.

The developing device 11 contains a developer (not shown) that contains toner.

The cleaning device 13 includes a blade (cleaning blade) 131 that contacts the surface of the electrophotographic photoconductor 7. The blade may be used in combination with an electrically conductive or insulating fibrous member.

FIG. 5 illustrates an example in which the cleaning device 13 includes a fibrous member 132 (roll-shaped) that supplies a lubricant 14 onto the surface of the electrophotographic photoconductor 7 and a fibrous member 133 (flat brush) that assists cleaning. These components are used as necessary.

Individual components will now be described.

The reference symbols are omitted in the description.

[Charging Device]

The charging device may be a charger of a contact charging type. The contact-type charger may take any of known forms such as a roller, a brush, a film, etc., but is preferably a roller-type charging member. The roller-type charging member may contact the photoconductor at a pressure of 250 mgf or more and 600 mgf or less.

The roller-type charging member is composed of a material adjusted to have an electric resistance effective as the charging member ($10^3\Omega$ or more and $10^8\Omega$ or less), and may be constituted by one layer or two or more layers.

The material used for forming the charging member contains a main material and a conductivity-imparting agent. Examples of the main material include synthetic rubber such as urethane rubber, silicone rubber, fluorine rubber, chloroprene rubber, butadiene rubber, ethylene-propylene-diene copolymer rubber (EPDM), and epichlorohydrin rubber, and elastomers such as polyolefin, polystyrene, and vinyl chloride. Examples of the conductivity-imparting agent include conductive carbon, metal oxides, and an ion conductive agent.

The charging device may be made by preparing a coating solution from a resin such as nylon, polyester, polystyrene, polyurethane, or silicone, blending a conductivity-imparting agent such as conductive carbon, a metal oxide, or an ion conductive agent into the coating solution, and applying the obtained coating solution by a technique such as dipping, spraying, or roll coating.

[Exposure Device]

A known exposure device is used as the exposure device. Examples of the exposure device include exposure devices that use polygon mirrors to refract laser beams emitted from an exposure light source such as a single light-emitting laser element that forms a micro spot diameter or a surface emitting laser element including a number of semiconductor lasers (luminous points) two-dimensionally arranged in a flat plane, and exposure devices that include a number of light-emitting diodes (LEDs) arranged in straight lines or into a staggered pattern. The light source applies light corresponding to the write image data from an image processor onto a photosensitive drum to write an image. The intensity of radiation during writing may be 0.5 $mJ/m^2$ or more and 5.0 $mJ/m^2$ or less on the surface of the photoconductor.

[Developing Device]

The developing device may be any known developing device. For example, a two-component-developer-type developing device that develops an image by causing a developing brush constituted by a carrier and toner to contact a photoconductor or a contact-type, monocomponent-developer-type developing device that causes toner to adhere to an electrically conductive rubber transfer roller (developing roller) to develop a toner image on the photoconductor may be used.

When a two-component development technique is employed, the direction in which the developing roller turns may be the same as or opposite to the direction of the turn of the photoconductor. The electric field applied to the developing roller may be direct current or direct current superimposed with alternating current.

The magnetic brush formed on the developing roller surface may be controlled with a layer-controlling member to suppress changes in magnetic brush density facing the photoconductor and to thereby control the magnetic brush density within an appropriate range.

The voltage applied to the developing roller is preferably −50 V or less and −600 V or more and more preferably −100 V or less and −350 V or more when the normal polarity of the toner is negative.

[Toner]

The toner may be any known toner and is not particularly limited. The toner contains a binder resin and a coloring agent and may further contain a releasing agent if needed. The toner may further contain an external additive such as silica or fluorocarbon resin particles.

The toner may further contain various components to control various characteristics. For example, when magnetic toner is used, magnetic powder (e.g., ferrite or magnetite), a metal such as reduced iron, cobalt, nickel, or manganese, or an alloy or a compound of the metal may be contained in the toner. A widely used charge-controlling agent such as a quaternary ammonium salt, a nigrosine compound, or a triphenylmethane pigment may be selected and added to the toner.

In addition to a polishing agent composed of inorganic particles, a known external additive such as a lubricant, a transfer aid, or the like may be added to the toner according to need.

The method for manufacturing the toner is not particularly limited. Examples of the toner manufacturing method include conventional pulverizing methods, wet-type melt spheroidizing methods that form toner in a dispersion medium, and polymerization methods such as suspension polymerization, dispersion polymerization, emulsion polymerization methods and emulsion aggregation methods.

[Carrier]

When the developer is a two-component developer containing toner and a carrier, any known carrier may be used without limitation. Examples of the carrier include carriers (uncoated carriers) composed of only core materials such as magnetic metals, e.g., iron oxide, nickel, and cobalt, and magnetic oxides such as ferrite and magnetite and resin-coated carriers composed of these core materials and resin layers on the surfaces of the core materials.

The two-component developer containing the carrier may have a mixing ratio (mass ratio) of the toner to the carrier within the range of toner:carrier=1:100 to 30:100 and more preferably toner:carrier=3:100 to 20:100.

[Transfer Device]

The transfer device is a device that applies a voltage having a polarity opposite to that of the toner to the photoconductor and the toner image so as to transfer the toner image formed on the photoconductor onto a recording medium in the transfer unit. The transfer device (transfer unit) included in the image-forming apparatus of the first exemplary embodiment has a charge-erasing function since the image-forming apparatus does not have a charge-erasing device for erasing charges of the electrophotographic photoconductor after transfer of the toner image onto the recording medium and before charging. In other words, the transfer device (transfer unit) included in the image-forming apparatus of the first exemplary embodiment is a device that applies a voltage having a polarity opposite to that the toner to the photoconductor and the toner image to transfer the toner image formed on the photoconductor onto the recording medium in the transfer section and that erases the potential of the charged photoconductor. The transfer device (transfer unit) included in the image-forming apparatus of the second exemplary embodiment which has a separate charge-erasing device (charge-erasing unit) may also have a charge-erasing function.

A transfer device that utilizes a known technique is used as the transfer device. Examples of the transfer technique include non-contact techniques such as corotron and scorotron techniques and contact techniques such as those using transfer rollers.

In transferring the toner image from the photoconductor, a direct transfer technique may be employed which uses a transfer belt to electrostatically adsorb and transport the recording medium and then transfer the toner image on the photoconductor onto the recording medium. The techniques for transferring the toner image from the photoconductor is not limited to this and an intermediate transfer technique that uses an intermediate transfer member such as an intermediate transfer belt or an intermediate transfer drum may be employed.

[Cleaning Device]

A known cleaning technique is used in the cleaning unit. For example, when a cleaning blade is used, the cleaning blade may include an elastic member in a portion that contacts the photoconductor surface and the elastic member preferably has a 100% modulus of 6.5 MPa or more, more preferably 7.0 Mpa or more, and most preferably 9.0 MPa or more. The 100% modulus of the elastic member is preferably 19.6 MPa or less and more preferably 15.0 MPa or less.

The elastic member preferably has a breaking elongation of 250% or more, more preferably 300% or more, and most preferably 350% or more.

A known rubber material is used as a material for forming the cleaning blade. Other materials may also be added. The rubber material is not particularly limited. Examples thereof include urethane rubber, silicone rubber, acrylic rubber, acrylonitrile rubber, butadiene rubber, and styrene rubber, and composite materials of these. The shape of the cleaning blade may be plate like and the cleaning blade is formed by centrifugal molding, extrusion molding, die molding, or the like.

[Charge-Erasing Device]

The image-forming apparatus of the first exemplary embodiment does not have a charge-erasing device for erasing charges of the electrophotographic photoconductor as discussed above. However, the image-forming apparatus of the second exemplary embodiment has a charge-erasing device.

A known charge-erasing device may be used as the charge-erasing device as long as the charge-erasing device may erase the potential of the photoconductor after the transfer of the toner image onto the recording medium and before charging. For example, the charge-erasing device may be a device that erases charges by controlling and applying a voltage to the photoconductor as with the transfer device having the charge-erasing function discussed above, or may be an optical charge-erasing device that optically erases the charges of the photoconductor.

Figure 6:
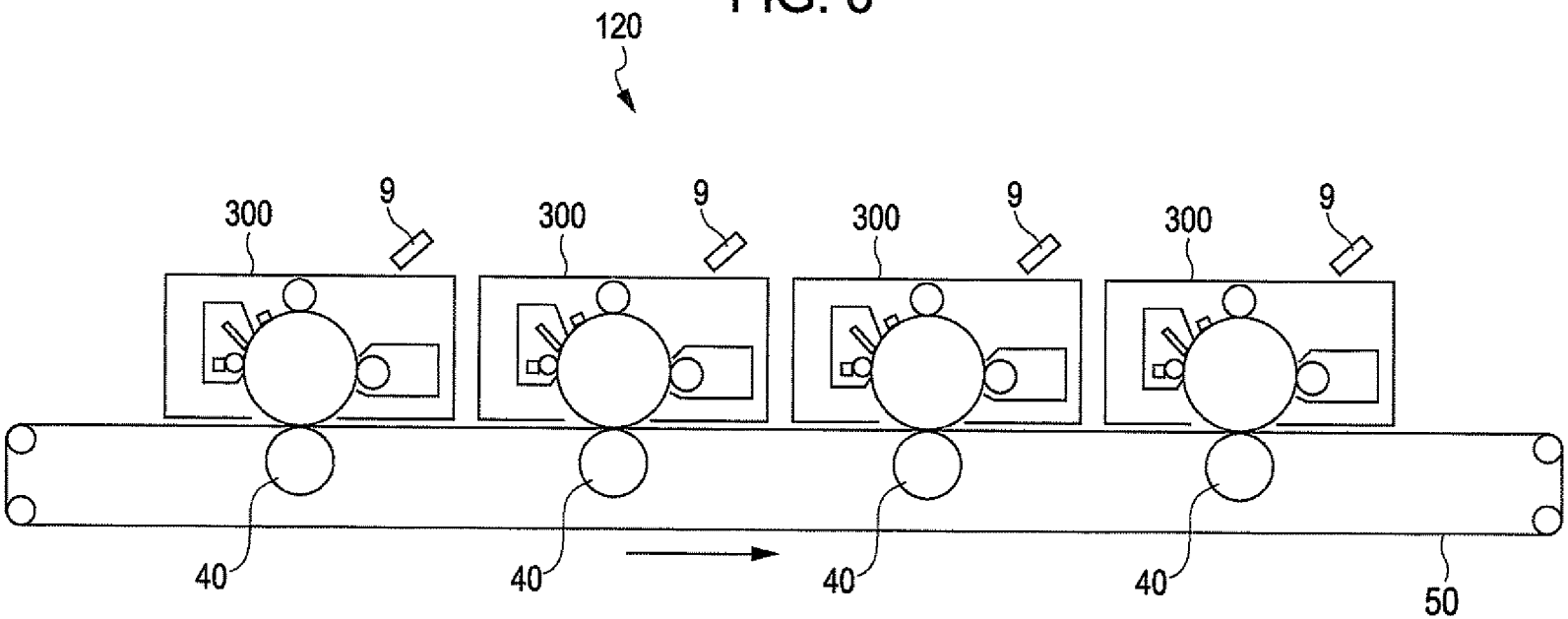
FIG. 6 is a schematic diagram of an image-forming apparatus according to another exemplary embodiment.

FIG. 6 is a schematic cross-sectional view showing an image-forming apparatus 120 according to another exemplary embodiment.

The image-forming apparatus 120 shown in FIG. 6 is a tandem-type full color image-forming apparatus equipped with four process cartridges 300.

According to this image-forming apparatus 120, four process cartridges 300 are aligned side-by-side on the intermediate transfer member 50 and one electrophotographic photoconductor is used for one color. The structure of the image-forming apparatus 120 is the same as the structure of the image-forming apparatus 100 except that the image-forming apparatus 120 is of a tandem type.

EXAMPLES

The present invention will now be specifically described by using Examples and Comparative Examples which do not limit the scope of the present invention. It should be noted that the "%" and "parts" used in the description below is on a mass basis unless otherwise noted.

Example 1

(Base)

A cylindrical aluminum base is prepared as a base.

(Undercoat Layer)

—Metal Oxide Particles—

One hundred parts of zinc oxide (average particle diameter: 70 nm, product of TAYCA Corporation, specific surface area: 15 $m^2/g$) and 500 parts of methanol are mixed with each other and stirred. To the resulting mixture, 1.25 parts of KBM 603 (product of Shin-Etsu Chemical Co., Ltd.) is added as a silane coupling agent, and the resulting mixture is stirred for 2 hours. Then methanol is removed by distillation under a reduced pressure and baking is performed at 120° C. for 3 hours to obtain zinc oxide (ZnO) particles M1 having surfaces treated with the silane coupling agent.

—Coating Solution 1 for Undercoat Layer—

| | |
|---|---|
| Zinc oxide particles M1 (metal oxide) | 60 parts |
| Alizarin (electron-accepting material) | 0.6 parts |
| Block isocyanate (curing agent) [Sumidur 3175, product of Sumitomo Bayer Urethane Co., Ltd.] | 13.5 parts |
| Butyral resin (binder resin) [BM-1, product of Sekisui Chemical Co., Ltd.] | 15 parts |
| Methyl ethyl ketone (solvent) | 85 parts |

Thirty eight parts of the mixed solution having the above-described composition and 25 parts of methyl ethyl ketone are mixed with each other and the resulting mixture is dispersed for 4 hours in a sand mill using glass beads having a diameter of 1 mm to obtain a dispersion D. The following components are mixed with the dispersion D to obtain a coating solution 1 for the undercoat layer.

| | |
|---|---|
| Dioctyltin dilaurate (catalyst) | 0.005 parts |
| Silicone resin particles [TOSPEARL 145, product of GE Toshiba Silicones] | 4.0 parts |

The coating solution 1 for the undercoat layer is applied on an aluminum base having a diameter of 30 mm by a dip coating technique and dried and cured at 180° C. for 40 minutes to obtain an undercoat layer having a thickness of 15 μm.

(Charge Generation Layer)

| | |
|---|---|
| *Chlorogallium phthalocyanine* crystals (charge generation material) [intense peaks at Bragg angles (2θ ± 0.2°) of at least 7.4°, 16.6°, 25.5°, and 28.3° with respect to the CuKα X-ray] | 15 parts |
| Vinyl chloride-vinyl acetate copolymer resin [VMCH, product of Nippon Unicar Company Limited] | 10 parts |
| n-Butyl alcohol | 300 parts |

A mixture having the above-described composition is dispersed for 4 hours in a sand mill using glass beads having a diameter of 1 mm to obtain a coating solution for a charge generation layer. The coating solution for the charge generation layer is applied on the undercoat layer by dip-coating and dried to obtain a charge generation layer having a thickness of 0.2 μm.

(Charge Transport Layer)

The components below are retained at a liquid temperature of 20° C. and mixed and stirred for 48 hours to obtain a suspension of ethylene tetrafluoride resin particles.

| | |
|---|---|
| Ethylene tetrafluoride resin particles [volume average particle diameter: 0.2 μm] | 0.6 parts |
| Fluorinated alkyl-containing methacryl copolymer [GF300, product of Toa Gosei Co., Ltd., weight-average molecular weight: 30,000] | 0.015 parts |
| Tetrahydrofuran (solvent) | 4 parts |
| Toluene (solvent) | 1 part |

The following components are mixed to obtain a charge transport material solution.

| | |
|---|---|
| Binder resin(specific polymer BP-1) [viscosity-average molecular weight: 55000] [Compound described above as an example of the specific polymer] | 6 parts |
| Charge transport material [A mixed system of the compound represented by T-1 below to the compound represented by T-2 below; the mixing ratio T-1:T-2 = 50:50 (molar ratio)] | 4 parts |
| 2,6-Di-tert-butyl-4-methylphenol (antioxidant) | 0.1 parts |
| Tetrahydrofuran (solvent) | 24 parts |
| Toluene(solvent) | 11 part |

-continued

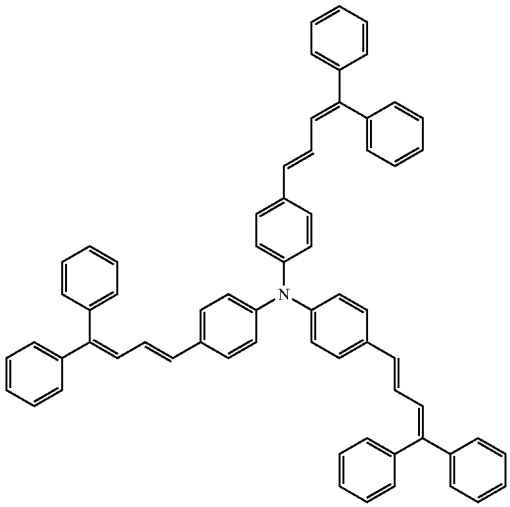

(T-1)

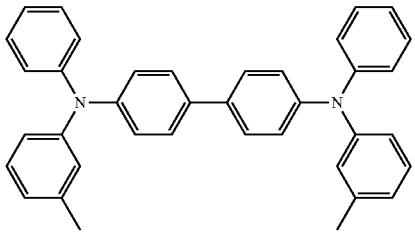

(T-2)

A mixed solution prepared by mixing and stirring the resulting charge transport material solution with the ethylene tetrafluoride resin particle suspension is subjected to a dispersion treatment six times at 500 kgf/cm$^2$ by using a high-pressure homogenizer (product of Yoshida Kikai Co., Ltd.) equipped with a penetration type chamber having micro channels.

To the resulting dispersion, 5 ppm of fluorine-modified silicone oil (trade name: FL-100, product of Shin-Etsu Chemical Co., Ltd.) is added, and the resulting mixture is thoroughly stirred to prepare a coating solution 1 for the charge transport layer.

The coating solution 1 for the charge transport layer is applied on the charge generation layer and dried at 135° C. for 30 minutes to form a charge transport layer having a thickness of 20 μm. The resultant product is used as an electrophotographic photoconductor of Example 1.

Example 2

An electrophotographic photoconductor of Example 2 including a charge transport layer 20 μm in thickness disposed on a charge generation layer is prepared as in Example 1 except that in forming the undercoat layer in Example 1, the thickness of the coating solution 1 for the undercoat layer applied is changed and an undercoat layer having a thickness of 10 μm is formed.

Example 3

A coating solution 2 for a charge transport layer is prepared as with preparation of the coating solution 1 for the charge transport layer in Example 1 except that the binder resin (specific polymer BP-1) in the charge transport material solution is changed to a specific polymer BP-2 (viscosity-average molecular weight: 54000).

An electrophotographic photoconductor of Example 3 having a 20-μm-thick charge transport layer on a charge generation layer is prepared as in Example 2 except that the coating solution 1 for the charge transport layer is changed to the coating solution 2 for the charge transport layer.

Example 4

A coating solution 3 for a charge transport layer is prepared as with preparation of the coating solution 1 for the charge transport layer in Example 1 except that the binder resin (specific polymer BP-1) in the charge transport material solution is changed to a specific polymer BP-3 (viscosity-average molecular weight: 60000).

An electrophotographic photoconductor of Example 4 having a 20-μm-thick charge transport layer on a charge generation layer is prepared as in Example 2 except that the coating solution 1 for the charge transport layer is changed to the coating solution 3 for the charge transport layer.

Example 5

An electrophotographic photoconductor of Example 5 including a charge transport layer 20 μm in thickness disposed on a charge generation layer is prepared as in Example 1 except that in preparing the electrophotographic photoconductor of Example 1, the thickness of the coating solution 1 for the undercoat layer applied is changed and an undercoat layer having a thickness of 5 μm is formed.

Example 6

Tin oxide ($SnO_2$) particles M2 surface-treated with a silane coupling agent are prepared as in Example 1 except that tin oxide (average particle diameter: 70 nm, product of Mitsubishi Materials Corporation) is used instead of zinc oxide (average particle diameter: 70 nm, product of TAYCA Corporation, specific surface area: 15 m$^2$/g) used in making the zinc oxide particles M1 in Example 1. Then a coating solution 2 for an undercoat layer is prepared as with preparation of the coating solution 1 for the undercoat layer except that the tin oxide particles M2 are used instead of the zinc oxide particles M1.

An electrophotographic photoconductor of Example 6 having a 20-μm-thick charge transport layer on a charge generation layer is prepared as in Example 1 except that the undercoat layer is formed by using the coating solution 2 for the undercoat layer instead of the coating solution 1 for the undercoat layer.

Example 7

Titanium oxide particles M3 surface-treated with a silane coupling agent are prepared as in Example 1 except that titanium oxide (CR-EL, product of Ishihara Sangyo Kaisha, Ltd.) is used instead of zinc oxide (average particle diameter: 70 nm, product of TAYCA Corporation, specific surface area: 15 m$^2$/g) used in making the zinc oxide particles M1 in Example 1. Then a coating solution 3 for an undercoat layer is prepared as with preparation of the coating solution 1 for the undercoat layer except that the titanium oxide particles M3 are used instead of the zinc oxide particles M1.

An electrophotographic photoconductor of Example 7 having a 20-μm-thick charge transport layer on a charge generation layer is prepared as in Example 1 except that the undercoat layer is formed by using the coating solution 3 for the undercoat layer instead of the coating solution 1 for the undercoat layer.

Example 8

A coating solution 4 for an undercoat layer is prepared as with preparation of the coating solution 1 for the undercoat layer except that trinitrofluorenone (electron-accepting material) is used instead of alizarin (electron-accepting material).

An electrophotographic photoconductor of Example 8 having a 20-μm-thick charge transport layer on a charge generation layer is prepared as in Example 1 except that the undercoat layer is formed by using the coating solution 4 for the undercoat layer instead of the coating solution 1 for the undercoat layer.

Example 9

An electrophotographic photoconductor of Example 9 is prepared as in Example 1 except that the thickness of the coating solution 1 for the charge transport layer applied is changed to form a charge transport layer having a thickness of 10 μm.

Example 10

An electrophotographic photoconductor of Example 10 is prepared as in Example 1 except that the thickness of the coating solution 1 for the charge transport layer applied is changed to form a charge transport layer having a thickness of 30 μm.

Example 11

A coating solution 4 for a charge transport layer is prepared as with preparation of the coating solution 1 for the charge transport layer in Example 1 except that the binder resin (specific polymer BP-1) in the charge transport material solution is changed to a specific polymer BP-5 (viscosity-average molecular weight: 50000).

An electrophotographic photoconductor of Example 11 having a 20-μm-thick charge transport layer on a charge generation layer is prepared as in Example 2 except that the coating solution 1 for the charge transport layer is changed to the coating solution 4 for the charge transport layer.

Example 12

A coating solution 5 for a charge transport layer is prepared as with preparation of the coating solution 1 for the charge transport layer in Example 1 except that the binder resin (specific polymer BP-1) in the charge transport material solution is changed to a specific polymer BP-6 (viscosity-average molecular weight: 50000).

An electrophotographic photoconductor of Example 12 having a 20-μm-thick charge transport layer on a charge generation layer is prepared as in Example 2 except that the coating solution 1 for the charge transport layer is changed to the coating solution 5 for the charge transport layer.

Example 13

A coating solution 6 for a charge transport layer is prepared as with preparation of the coating solution 1 for the charge transport layer in Example 1 except that the binder resin (specific polymer BP-1) in the charge transport material solution is changed to a specific polymer BP-10 (viscosity-average molecular weight: 50000).

An electrophotographic photoconductor of Example 13 having a 20-μm-thick charge transport layer on a charge generation layer is prepared as in Example 2 except that the coating solution 1 for the charge transport layer is changed to the coating solution 6 for the charge transport layer.

Example 14

A coating solution 7 for a charge transport layer is prepared as with preparation of the coating solution 1 for the charge transport layer in Example 1 except that the binder resin (specific polymer BP-1) in the charge transport material solution is changed to a specific polymer BP-11 (viscosity-average molecular weight: 50000).

An electrophotographic photoconductor of Example 14 having a 20-μm-thick charge transport layer on a charge generation layer is prepared as in Example 2 except that the coating solution 1 for the charge transport layer is changed to the coating solution 7 for the charge transport layer.

Example 15

A coating solution 8 for a charge transport layer is prepared as with preparation of the coating solution 1 for the charge transport layer in Example 1 except that the binder resin (specific polymer BP-1) in the charge transport material solution is changed to a specific polymer BP-15 (viscosity-average molecular weight: 50000).

An electrophotographic photoconductor of Example 15 having a 20-μm-thick charge transport layer on a charge generation layer is prepared as in Example 2 except that the coating solution 1 for the charge transport layer is changed to the coating solution 8 for the charge transport layer.

Example 16

A coating solution 9 for a charge transport layer is prepared as with preparation of the coating solution 1 for the charge transport layer in Example 1 except that the binder resin (specific polymer BP-1) in the charge transport material solution is changed to a specific polymer BP-17 (viscosity-average molecular weight: 50000).

An electrophotographic photoconductor of Example 16 having a 20-μm-thick charge transport layer on a charge generation layer is prepared as in Example 2 except that the coating solution 1 for the charge transport layer is changed to the coating solution 9 for the charge transport layer.

Comparative Example 1

An electrophotographic photoconductor of Comparative Example 1 including a charge transport layer 20 μm in thickness disposed on a charge generation layer is prepared as in Example 1 except that the thickness of the coating solution 1 for the undercoat layer applied is changed to form an undercoat layer having a thickness of 17 μm.

Comparative Example 2

An electrophotographic photoconductor of Comparative Example 2 including a charge transport layer 20 μm in thickness disposed on a charge generation layer is prepared as in Example 1 except that the thickness of the coating solution 1 for the undercoat layer applied is changed to form an undercoat layer having a thickness of 23 μm.

Comparative Example 3

A coating solution 101 for an undercoat layer is prepared as with the preparation of the coating solution 1 for the undercoat layer except that alizarin (electron-accepting material) is not used.

An electrophotographic photoconductor of Comparative Example 3 having a 20-μm-thick charge transport layer on a charge generation layer is prepared as in Example 1 except that the undercoat layer is formed by using the coating solution 101 for the undercoat layer instead of the coating solution 1 for the undercoat layer.

Comparative Example 4

A coating solution 101 for a charge transport layer is prepared as with preparation of the coating solution 1 for the charge transport layer except that a polymer (viscosity-average molecular weight: 50000) of Comparative Compound 1 below is used instead of BP-1.

An electrophotographic photoconductor of Comparative Example 4 having a 20-μm-thick charge transport layer on a charge generation layer is prepared as in Example 1 except that the charge transport layer is formed by using the coating solution 101 for the charge transport layer instead of the coating solution 1 for the charge transport layer.

(Comparative Compound 1)

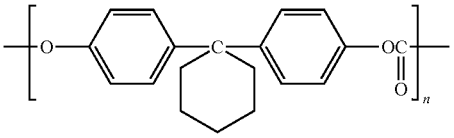

Comparative Example 5

An electrophotographic photoconductor of Comparative Example 5 having a 20-μm-thick charge transport layer on a charge generation layer is prepared as in Comparative Example 2 except that the charge transport layer is formed by using the coating solution 101 for the charge transport layer instead of the coating solution 1 for the charge transport layer.

Comparative Example 6

An electrophotographic photoconductor of Comparative Example 6 having a 20-μm-thick charge transport layer on a charge generation layer is prepared as in Comparative Example 3 except that the charge transport layer is formed by using the coating solution 101 for the charge transport layer instead of the coating solution 1 for the charge transport layer.

Comparative Example 7

A coating solution 102 for an undercoat layer is prepared as with the preparation of the coating solution 1 for the undercoat layer except that zinc oxide particles M1 are not used.

An electrophotographic photoconductor of Comparative Example 7 having a 20-μm-thick charge transport layer on a charge generation layer is prepared as in Example 1 except that the undercoat layer is formed by using the coating solution 102 for the undercoat layer instead of the coating solution 1 for the undercoat layer.

Comparative Example 8

An electrophotographic photoconductor of Comparative Example 8 having a 20-μm-thick charge transport layer on a charge generation layer is prepared as in Example 1 except that the coating solution 1 for the charge transport layer is not applied and the undercoat layer is not formed.

<Image Formation>

The electrophotographic photoconductors of Examples and Comparative Examples are mounted in a modified model of DocuCentre III C3300 produced by Fuji Xerox Co., Ltd., to conduct evaluation of image memory phenomenon and durability. The details of the method and standards for evaluation are as follows. The results of evaluation are shown in Table 1.

1. Evaluation of Image Memory Phenomenon

The electrophotographic photoconductors of Examples 1 to 9 and Comparative Examples 1 to 8 are mounted in a modified model of DocuCentre III C3300 having a charge-erasing device and evaluation of the image memory phenomenon is conducted in a normal temperature, normal humidity (20° C., 40% RH) environment. In particular, a character image is formed at a first cycle, a 30% halftone image is formed at a second cycle, and whether the image hysteresis from the first cycle is observed or not is determined. The same evaluation is also conducted after removing the charge-erasing device from the modified model of DocuCentre III C3300.

—Evaluation Standards—

A: No hysteresis from the first cycle is observed.

B: Hysteresis from the first cycle is observed in some parts.

C: All parts of hysteresis from the first cycle are weakly visible.

D: All parts of hysteresis from the first cycle are strongly visible.

2. Evaluation of Durability

The electrophotographic photoconductors of Examples 1 to 9 and Comparative Examples 1 to 8 are mounted in a modified model of DocuCentre III C3300 having a charge-erasing device and an image-forming test is conducted by printing images on 10,000 sheets in a low-temperature, low-humidity (10° C., 20% RH) environment and then printing images on 10,000 sheets in a high-temperature, high-humidity (28° C., 75% RH) environment. Subsequently, 50% halftone (black) images are formed and the resulting images are evaluated according to the following standards. The evaluation of durability is also conducted after removing the charge-erasing device from the modified model of DocuCentre III C3300.

—Evaluation Standards—

A: Good

B: Slight decrease in image density

C: Low image density

D: Streak-shaped defects occurred

| | | Layer configuration | | | | | Evaluation | | | |
|---|---|---|---|---|---|---|---|---|---|---|
| | | Undercoat layer | | | Photosensitive layer (electron-transport layer) | | Image memory phenomenon Charge-erasing device | | Durability Charge-erasing device | |
| | | Metal oxide | Electron-accepting material | T ** (μm) | Type | T ** (μm) | Yes | No | Yes | NO |
| Examples | 1 | ZnO | Alizarin | 15 | BP-1 | 20 | A | B | B | A |
| | 2 | ZnO | Alizarin | 10 | BP-1 | 20 | A | A | A | A |
| | 3 | ZnO | Alizarin | 10 | BP-2 | 20 | A | A | A | A |
| | 4 | ZnO | Alizarin | 10 | BP-3 | 20 | A | A | B | A |
| | 5 | ZnO | Alizarin | 5 | BP-1 | 20 | A | A | A | A |
| | 6 | $SnO_2$ | Alizarin | 10 | BP-1 | 20 | A | B | A | A |
| | 7 | $TiO_2$ | Alizarin | 10 | BP-1 | 20 | A | B | A | A |
| | 8 | ZnO | Trinitrofluorenone | 10 | BP-1 | 20 | B | B | A | A |
| | 9 | ZnO | Alizarin | 10 | BP-1 | 10 | A | B | A | A |
| | 10 | ZnO | Alizarin | 10 | BP-1 | 30 | A | A | A | A |
| | 11 | ZnO | Alizarin | 10 | BP-5 | 20 | B | B | B | A |
| | 12 | ZnO | Alizarin | 10 | BP-6 | 20 | B | B | B | A |
| | 13 | ZnO | Alizarin | 10 | BP-10 | 20 | B | B | B | A |
| | 14 | ZnO | Alizarin | 10 | BP-11 | 20 | A | A | B | B |
| | 15 | ZnO | Alizarin | 10 | BP-15 | 20 | A | B | A | A |
| | 16 | ZnO | Alizarin | 10 | BP-17 | 20 | A | B | B | B |
| C. Ex. * | 1 | ZnO | Alizarin | 17 | BP-1 | 20 | B | C | C | B |
| | 2 | ZnO | Alizarin | 23 | BP-1 | 20 | B | C | C | C |
| | 3 | ZnO | None | 15 | BP-1 | 20 | B-C | C-D | C-D | C |
| | 4 | ZnO | Alizarin | 15 | Cmp. 1 | 20 | B-C | D | C | C |
| | 5 | ZnO | Alizarin | 23 | Cmp. 1 | 20 | B-C | D | C | C |
| | 6 | ZnO | None | 15 | Cmp. 1 | 20 | B-C | D | D | D |
| | 7 | None | Alizarin | 15 | BP-1 | 20 | C | D | B | B |
| | 8 | | No undercoat layer | | BP-1 | 20 | D | D | B | B |

* Comparative Examples
** Thickness

In Table 1, the "Type" column under the photosensitive layer (electron transport layer) column indicates the type of the binder resin in the electron transport layer and "Cmp. 1" indicates Comparative Compound 1 described above.

The results in Table 1 show that the electrophotographic photoconductors of Examples are excellent in terms of the image memory phenomenon and durability and exhibit high image quality and long lifetime. Image-forming apparatuses and process cartridges incorporating such electrophotographic photoconductors will also exhibit high image quality and long lifetime.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments are chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoconductor comprising:

an electrically conductive base;

an undercoat layer disposed on the base that contains a metal oxide and an electron-accepting material and has a thickness of from about 3 μm to about 15 μm; and a photosensitive layer disposed on the undercoat layer containing a polymer consisting of a repeating unit represented by general formula (1)

General formula (1)

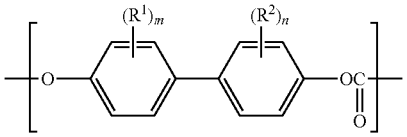

where $R^1$ and $R^2$ each independently represent a halogen atom, an alkyl group having 1 to 6 carbon atoms, a cycloalkyl group having 5 to 7 carbon atoms, or an aryl group having 6 to 12 carbon atoms; and m and n each independently represent an integer of 0 to 4, wherein the polymer has a viscosity-average molecular weight of from about 50000 to about 70000.

2. The electrophotographic photoconductor according to claim 1, further comprising an overcoat layer.

3. The electrophotographic photoconductor according to claim 1, wherein the undercoat layer has a thickness of from about 5 μm to about 10 μm.

4. The electrophotographic photoconductor according to claim 1, wherein the metal oxide has a volume-average particle diameter of from about 50 nm to about 2000 nm.

5. The electrophotographic photoconductor according to claim 1, wherein the polymer is contained in an amount of from about 30 mass % to about 80 mass % relative to a total solid content of the photosensitive layer on a mass basis.

6. A process cartridge comprising the electrophotographic photoconductor of claim 1, wherein the process cartridge is detachably mountable to an image-forming apparatus.

7. The process cartridge according to claim 6, further comprising a charge-erasing unit.

8. The process cartridge according to claim 6, wherein the electrophotographic photoconductor further comprises an overcoat layer.

9. An electrophotographic image-forming apparatus comprising:

the electrophotographic photoconductor according to claim 1;

a charging unit that charges a surface of the electrophotographic photoconductor;

an exposing unit that exposes the charged electrophotographic photoconductor to form an electrostatic latent image;

a developing unit that develops the electrostatic latent image with charged toner to form a toner image; and a transfer unit that transfers the toner image onto a recording medium.

10. The electrophotographic image-forming apparatus according to claim 9, further comprising a charge-erasing unit for the electrophotographic photoconductor.

11. The electrophotographic photoconductor according to claim 1, wherein the photosensitive layer has a thickness of from 5 μm to 20 μm.

12. An electrophotographic photoconductor, comprising:

an electrically conductive base;

an undercoat layer disposed on the base that contains a metal oxide and an electron-accepting material and has a thickness of from about 3 μm to about 15 μm; and a photosensitive layer disposed on the undercoat layer containing a polymer wherein the polymer is a copolymer consisting of two repeating units, one of the repeating units being represented by general formula (1)

General formula (1)

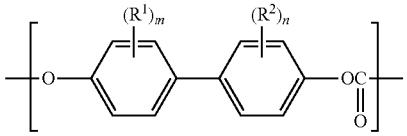

where $R^1$ and $R^2$ each independently represent a halogen atom, an alkyl group having 1 to 6 carbon atoms, a cycloalkyl group having 5 to 7 carbon atoms, or an aryl group having 6 to 12 carbon atoms; and m and n each independently represent an integer of 0 to 4, and the other repeating unit being represented by general formula (2)

General formula (2)

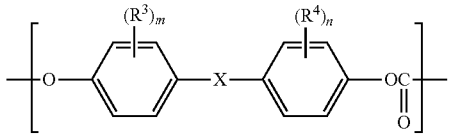

where $R^3$ and $R^4$ each independently represent a halogen atom, an alkyl group having 1 to 6 carbon atoms, a cycloalkyl group having 5 to 7 carbon atoms, or an aryl group having 6 to 12 carbon atoms; and m and n each independently represent an integer of 0 to 4; X represents —$CR^5R^6$—, a 1,1-cycloalkylene group having 5 to 11 carbon atoms, an α,ω-alkylene group having 2 to 10 carbon atoms, —O—, —S—, —SO—, or —$SO_2$—; and $R^5$ and $R^6$ each independently represent a hydrogen atom, a trifluoromethyl group, an alkyl group having 1 to 6 carbon atoms, or an aryl group having 6 to 12 carbon atoms, wherein the polymer has a viscosity-average molecular weight of from about 50000 to about 70000.

13. The electrophotographic photoconductor according to claim 12, wherein, when a ratio of the repeating unit represented by general formula (1) is represented by a (mol %) and a ratio of the repeating unit represented by general formula (2) is represented by b (mol %), a ratio a/b of the copolymer is from about 0.05 to about 0.9.

14. The electrophotographic photoconductor according to claim 12, wherein X in general formula (2) is —S—.

15. A process cartridge comprising the electrophotographic photoconductor of claim 12, wherein the process cartridge is detachably mountable to an image-forming apparatus.

16. An electrophotographic image-forming apparatus comprising:

the electrophotographic photoconductor according to claim 12;

a charging unit that charges a surface of the electrophotographic photoconductor;

an exposing unit that exposes the charged electrophotographic photoconductor to form an electrostatic latent image;

a developing unit that develops the electrostatic latent image with charged toner to form a toner image; and a transfer unit that transfers the toner image onto a recording medium.

17. The electrophotographic photoconductor according to claim 12, wherein the photosensitive layer has a thickness of from 5 μm to 20 μm.

* * * * *